US012687308B2

(12) United States Patent
Sawada

(10) Patent No.: US 12,687,308 B2
(45) Date of Patent: Jul. 21, 2026

(54) AIR CONDITIONING DEVICE

(71) Applicant: FUJITSU GENERAL LIMITED, Kanagawa (JP)

(72) Inventor: Hirotaka Sawada, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 129 days.

(21) Appl. No.: 18/284,785

(22) PCT Filed: Mar. 9, 2022

(86) PCT No.: PCT/JP2022/010174
§ 371 (c)(1),
(2) Date: Sep. 28, 2023

(87) PCT Pub. No.: WO2022/209651
PCT Pub. Date: Oct. 16, 2022

(65) Prior Publication Data

US 2024/0191884 A1 Jun. 13, 2024

(30) Foreign Application Priority Data

Mar. 30, 2021 (JP) ..... 2021-058827

(51) Int. Cl.
*F24F 1/0063* (2019.01)
*F24F 1/0025* (2019.01)
*F24F 1/0073* (2019.01)

(52) U.S. Cl.
CPC ..... *F24F 1/0063* (2019.02); *F24F 1/0025* (2013.01); *F24F 1/0073* (2019.02)

(58) Field of Classification Search
CPC ..... F24F 1/0025; F24F 1/0057; F24F 1/0071; F24F 1/0073; F24F 13/08–13/085; F24F 8/108
See application file for complete search history.

(56) References Cited

U.S. PATENT DOCUMENTS 6,074,450 A * 6/2000 Raber ..... B01D 46/523 55/497
2002/0144513 A1* 10/2002 Gunji ..... F24F 13/28 62/298

(Continued)

FOREIGN PATENT DOCUMENTS

CN 1918434 A 2/2007
CN 103528132 A 1/2014

(Continued)

OTHER PUBLICATIONS

Jan. 29, 2025, European Search Report issued for related EP Application No. 22779874.1.

(Continued)

*Primary Examiner* — Nelson J Nieves
(74) *Attorney, Agent, or Firm* — Paratus Law Group, PLLC

(57) ABSTRACT

An air conditioning device includes a tangential fan, a columnar support, a heat exchanger that is disposed between the columnar support and the tangential fan, and a mechanism configured to rotate the tangential fan around a rotation axis and cause air to pass through the heat exchanger, wherein at least some part of the columnar support is placed along a straight line that is inclined with respect to the rotation axis.

2 Claims, 14 Drawing Sheets

(56) References Cited

U.S. PATENT DOCUMENTS

| | | | | |
|---|---|---|---|---|
| 2008/0181764 | A1 | 7/2008 | Hirakawa et al. | |
| 2017/0131208 | A1* | 5/2017 | Kim | G01N 15/0656 |
| 2018/0023820 | A1* | 1/2018 | Kim | F24F 13/30 250/435 |
| 2020/0018493 | A1* | 1/2020 | Shirota | F24F 1/0011 |

FOREIGN PATENT DOCUMENTS

| | | | | |
|---|---|---|---|---|
| CN | 110366663 | A | 10/2019 | |
| EP | 1607692 | A1 * | 12/2005 | F24F 1/0007 |
| JP | 2006-105444 | A | 4/2006 | |
| JP | 2007-010240 | A | 1/2007 | |
| JP | 2007-040543 | A | 2/2007 | |
| JP | 2010-156210 | A | 7/2010 | |
| JP | 2010-210165 | A | 9/2010 | |
| JP | 2011-012881 | A | 1/2011 | |
| JP | 6625305 | B1 | 12/2019 | |
| WO | WO 2020/213031 | A1 | 10/2020 | |

OTHER PUBLICATIONS

Jan. 17, 2026, Chinese Office Action issued for related CN Application No. 202280021752.9.

* cited by examiner

AIR CONDITIONING DEVICE

CROSS REFERENCE TO PRIOR APPLICATION

This application is a National Stage Patent Application of PCT International Patent Application No. PCT/JP2022/010174 (filed on Mar. 9, 2022) under 35 U.S.C. § 371, which claims priority to Japanese Patent Application No. 2021-058827 (filed on Mar. 30, 2021), which are all hereby incorporated by reference in their entirety.

FIELD

The application concerned relates to an air conditioning device.

BACKGROUND

An indoor equipment for an air conditioning device is known in which an air blower is installed for blowing in the air using a rotatable tangential fan. The casing in which the tangential fan is stored has a tongue region placed in the vicinity of the tangential fan. When the tangential fan rotates in such an indoor equipment for an air conditioning device, a blade pitch sound occurs between the tangential fan and the tongue region. As far as an indoor equipment for an air conditioning device is concerned, in order to reduce the blade pitch sound without affecting the air blowing performance, it is common practice to improve the shape of a plurality of blades disposed in the tangential fan and to improve the shape of the tongue region, (refer to Patent Literature 1 to Patent Literature 3).

CITATION LIST

Patent Literature

[Patent Literature 1] Japanese Laid-open Patent Publication No. 2007-10240

[Patent Literature 2] Japanese Laid-open Patent Publication No. 2007-40543

[Patent Literature 3] Japanese Laid-open Patent Publication No. 2010-156210

SUMMARY

Technical Problem

In an indoor equipment for an air conditioning device, due the wind noise generated in the space through which the blown air passes, the level of noise undergoes further increase.

The application concerned is made in view of the issues mentioned above, and it is an objective of the application concerned to provide an air conditioning device that reduces the blade pitch sound and at the same time holds down an increase in the level of noise attributed to the wind noise.

Solution to Problem

According to an aspect of an embodiment, an air conditioning device includes a tangential fan, a columnar support, a heat exchanger that is placed between the columnar support and the tangential fan, and a mechanism configured to rotate the tangential fan around a rotation axis and cause air to pass through the heat exchanger, wherein at least some part of the columnar support is placed along a straight line that is inclined with respect to the rotation axis.

Advantageous Effects of Invention

The air condition device according to the application concerned is able to reduce the blade pitch sound and at the same time hold down an increase in the level of noise attributed to the wind noise.

DESCRIPTION OF EMBODIMENTS

Figure 1:
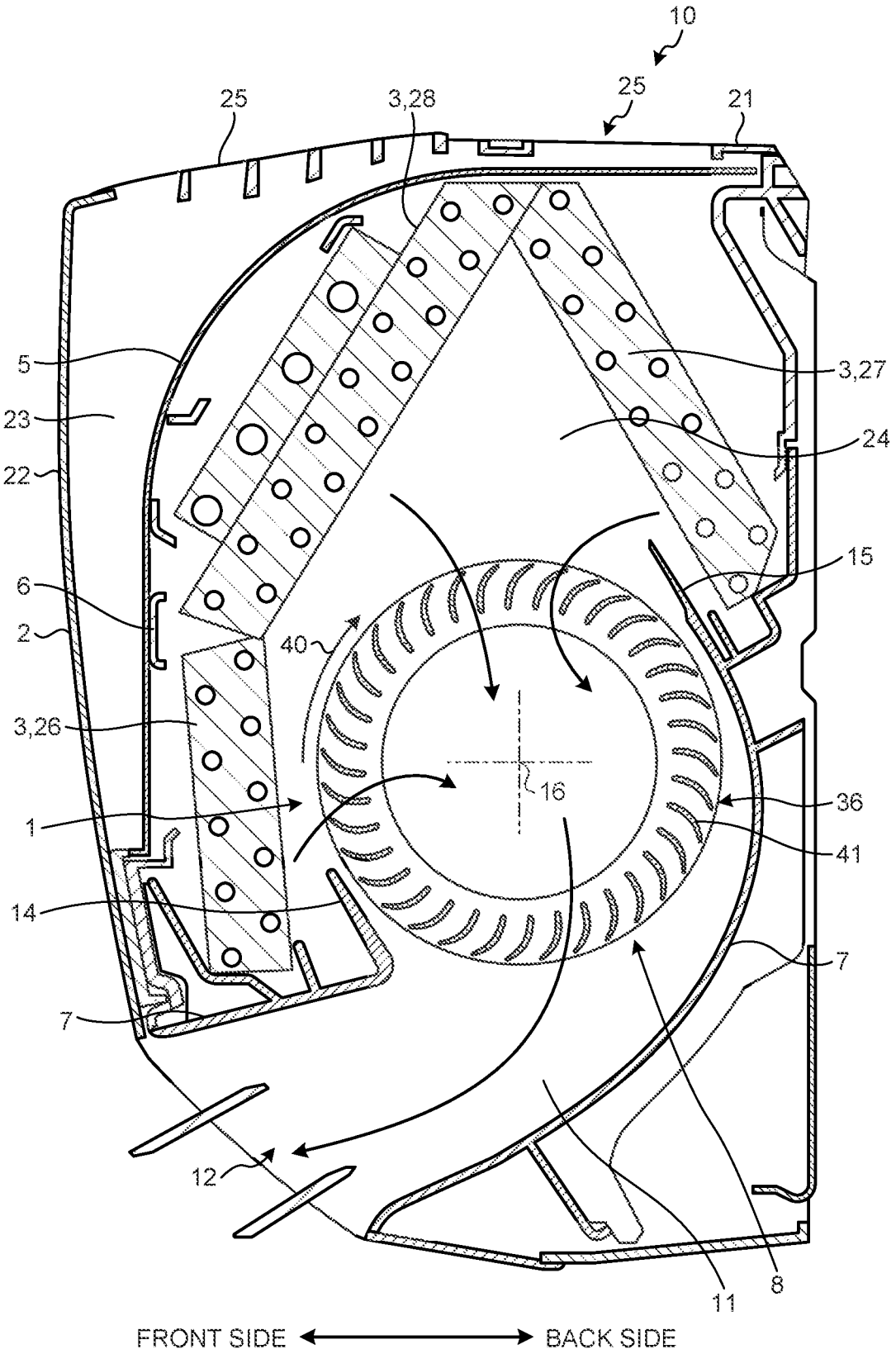
FIG. 1 is a cross-sectional view of an indoor equipment of an air conditioning device according to a first embodiment.

Exemplary embodiments of an indoor equipment according to the application concerned are described below with reference to the accompanying drawings. However, the application concerned is not limited by the embodiments described below. In the following explanation, identical constituent elements are referred to by the same reference numerals, and the same explanation is not repeated.

First Embodiment

FIG. 1 is a cross-sectional view of an indoor equipment of an air conditioning device according to a first embodiment. The air conditioning device includes an indoor equipment 10 and an outdoor equipment (not illustrated). The outdoor equipment is installed outdoors. The indoor equipment 10 is installed on the wall surface of an air-conditioned room that is isolated from the outdoors. The indoor equipment 10 includes an air blower 1, a housing 2, a heat exchanger 3, a filter 5, and a columnar support 6.

The housing 2 includes a housing main body 21 and a front panel 22. The housing main body 21 is formed roughly in a box shape. The housing main body 21 is fixed to the wall surface on which the indoor equipment 10 is to be installed. On the front side of the housing main body 21, a frontside opening 23 is formed. The front panel 22 is formed roughly in a plate shape. The front panel 22 is disposed on the front side of the housing main body 21 in such a way that the frontside opening 23 gets covered by the front panel 22. Moreover, the front panel 22 is attached to the housing main body 21 in a detachably attachable manner, and is fixed to the housing main body 21.

On the inside of the housing 2, an air passageway 24 is formed. In the upper portion of the housing main body 21, a suction opening 25 is formed so that the air passageway 24 gets communicated with the outside of the housing 2. The air blower 1 is disposed in the lower portion of the air passageway 24.

The heat exchanger 3 includes a frontside heat exchanger 26, an upper backside heat exchanger 27, and an upper frontside heat exchanger 28. The frontside heat exchanger 26 is formed in a plate shape, is disposed in the air passageway 24 in between the air blower 1 and the front panel 22, and is fixed to the housing main body 21. The plane following the frontside heat exchanger 26 is parallel to a rotation axis 16 and is roughly perpendicular to the front back direction of the indoor equipment 10 (the direction from the front side to the back side). The upper backside heat exchanger 27 is formed in a plate shape. Moreover, the upper backside heat exchanger 27 is inclined in such a way that the lower end thereof is placed more on the back side than the upper end thereof. Furthermore, the upper backside heat exchanger 27 is disposed in the air passageway 24 in between the suction opening 25 and the air blower 1, and is fixed to the housing main body 21. The plane following the upper backside heat exchanger 27 is parallel to the rotation axis 16.

The heat exchanger 3 includes a plurality of fins (not illustrated) and a plurality of heat transfer tubes (not illustrated). The fins are formed in a plate shape and are disposed along a plurality of planes orthogonal to the rotation axis 16. On the inside of each heat transfer tube, a flow passage is formed through which a refrigerant can flow. Each heat transfer tube is formed in a rod shape, penetrates through a plurality of fins, and remains thermally in contact with the fins. The heat transfer tubes are placed along a plurality of straight lines parallel to the rotation axis 16.

The upper frontside heat exchanger 28 is formed in a plate shape, and is disposed in the air passageway 24 in between the suction opening 25 and the air blower 1. Moreover, the upper frontside heat exchanger 28 is inclined to have its lower end linked to the upper end of the frontside heat exchanger 26 and have its upper end linked to the upper end of the upper backside heat exchanger 27. Furthermore, the upper frontside heat exchanger 28 is fixed to the housing main body 21.

The filter 5 is disposed in the air passageway 24 in between the heat exchanger 3 and the suction opening 25, is attached to the housing main body 21 in a detachably attachable manner, and is fixed to the housing main body 21. The filter 5 removes dust from the air that flows through the air passageway 24. The columnar support 6 is disposed in the air passageway 24 in between the heat exchanger 3 and the filter 5, and is fixed to the housing main body 21. The columnar support 6 prevents the filter 5 from making contact with the heat exchanger 3, and prevents deformation of the fins provided in the heat exchanger 3.

The air blower 1 includes a fan casing 7 and a tangential fan 8. The fan casing 7 either is disposed on the inside of the housing 2 and is fixed to the housing main body 21, or is formed in an integrated manner with the housing main body 21. In the fan casing 7, a draft air duct 11 and a vent 12 are formed. The draft air duct 11 is formed on the inside of the fan casing 7. One end of the draft air duct 11 is connected to that region in the air passageway 24 which is in between the air blower 1 and the heat exchanger 3. The vent 12 is formed at the lower end of the fan casing 7. The other end of the draft air duct 11 is connected to the vent 12, and is connected to the outside of the housing 2 of the indoor equipment 10 via the vent 12.

The tangential fan 8 is disposed in the draft air duct 11. The fan casing 7 includes a frontside tongue portion 14 and a backside tongue portion 15. The frontside tongue portion 14 is disposed on the front side of the draft air duct 11. The backside tongue portion 15 is disposed on the back side of the draft air duct 11. When the tangential fan 8 is rotary driven by a mechanism explained later, an air current is generated that passes through the heat exchanger 3.

Figure 2:
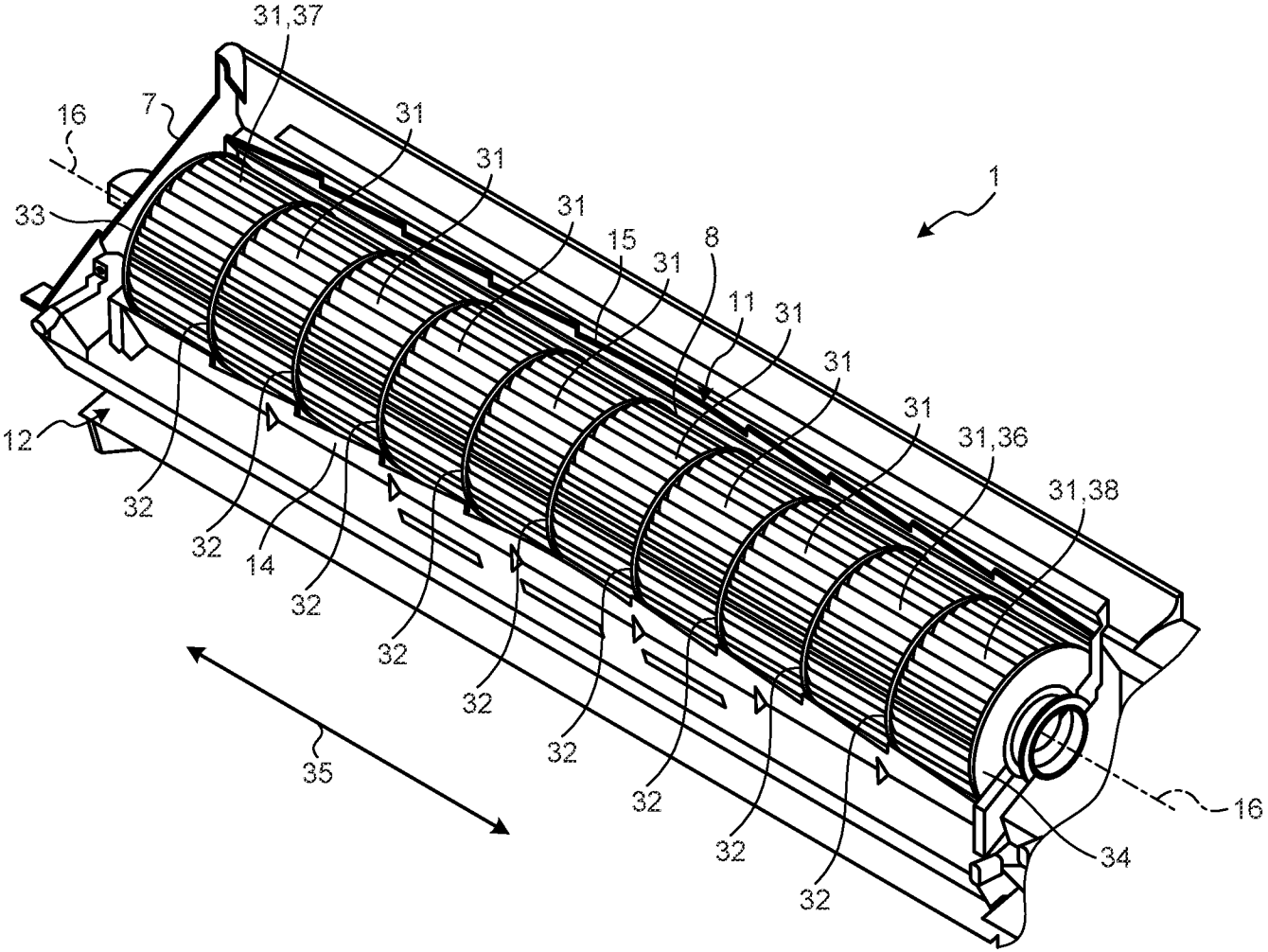
FIG. 2 is a perspective view of an air blower.

FIG. 2 is a perspective view of the air blower 1. The tangential fan 8 is formed roughly in a cylindrical shape, is disposed in the draft air duct 11 along the rotation axis 16, and is supported by the fan casing 7 to be rotatable around the rotation axis 16. The tangential fan 8 includes a plurality of impellers 31, a plurality of dividers 32, a first endplate 33, and a second endplate 34. The impellers 31 are arranged in an axial direction 35 that is parallel to the rotation axis 16, and are fixed to each other via the dividers 32. From among the impellers 31, one impeller 36 includes a plurality of blades 41 as illustrated in FIG. 1. Each blade 41 is formed in what is called an airfoil profile. The blades 41 are arranged in the circumferential direction centered on the rotation axis 16, and are disposed along straight lines parallel to the rotation axis 16. From among the impellers 31, each other impeller other than the impeller 36 also includes a plurality of blades 41 in an identical manner to the impeller 36.

Each divider 32 is formed roughly in a disk shape. As illustrated in FIG. 2, the dividers 32 are disposed along a plurality of planes orthogonal to the rotation axis 16. Moreover, each divider 32 is placed in between two impellers 31, and is fixed to the blades 41 of those two impellers 31.

The first endplate 33 is formed roughly in a disk shape. The first endplate 33 is disposed at one end of the tangential fan 8 and along a plane orthogonal to the rotation axis 16, and is fixed to a plurality of blades 41 of a first type impeller 37 that, from among the impellers 31, is placed at one end. The second endplate 34 is formed roughly in a disk shape. The second endplate 34 is disposed at the other end of the tangential fan 8 and along a plane orthogonal to the rotation axis 16, and is fixed to a plurality of blades 41 of a second type impeller 38 that, from among the impellers 31, is placed at the other end. From among the impellers 31, third type impellers other than the first type impeller 37 and the second type impeller 38 are disposed in between the first type impeller 37 and the second type impeller 38.

The air blower 1 further includes a motor unit (not illustrated). The motor unit is a mechanism for rotating the tangential fan 8 around the rotation axis 16 and in a predetermined rotation direction 40 as illustrated in FIG. 1. The impellers 31 are formed in such a way that, when the tangential fan 8 rotates in the rotation direction 40, the air flows through the draft air duct 11 toward the vent 12.

Figure 3:
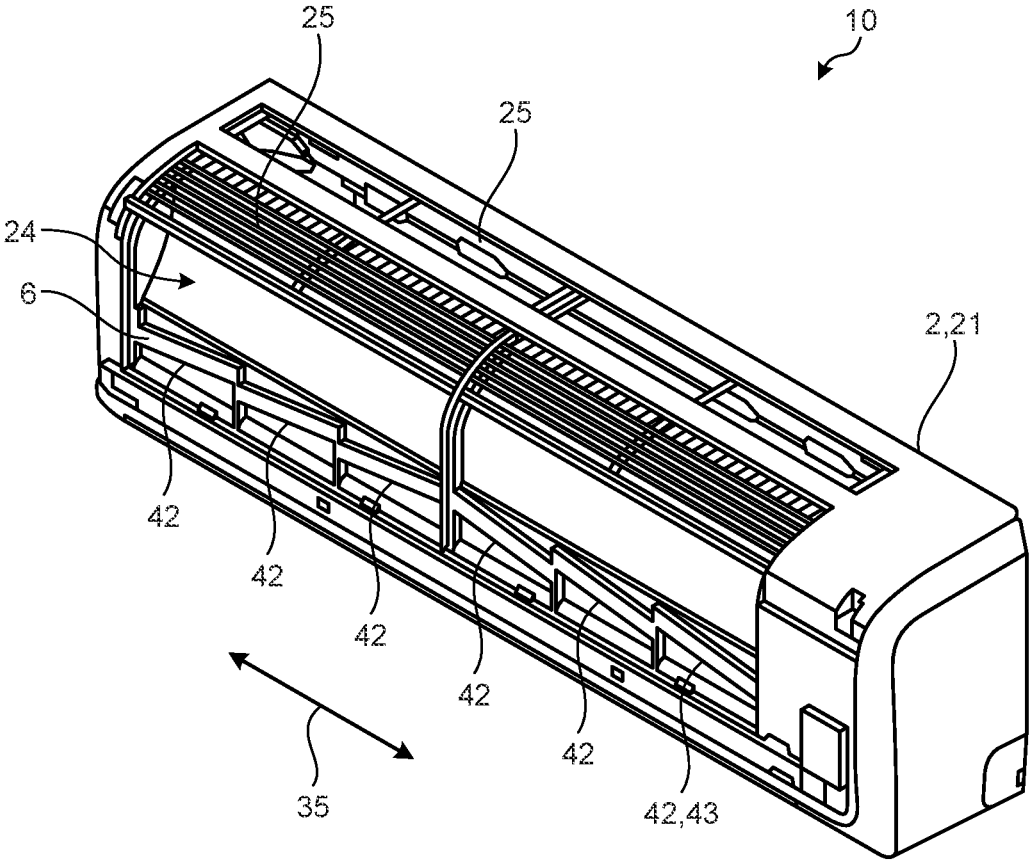
FIG. 3 is a perspective view of the indoor equipment from which a filter and a front panel have been removed.

FIG. 3 is a perspective view of the indoor equipment 10 from which the filter 5 and the front panel 22 have been removed. One end of the columnar support 6 is disposed at one end in the axial direction 35 of the air passageway 24, and the other end of the columnar support 6 is disposed at the other end in the axial direction 35 of the air passageway 24. The columnar support 6 includes a plurality of oblique columnar support portions 42. From among the oblique columnar support portions 42, one oblique columnar support portion 43 is formed in a rod shape. The straight line that follows the oblique columnar support portion 43 is inclined with respect to the axial direction 35, that is, is neither parallel to the axial direction 35 nor orthogonal to the axial direction 35. In the first embodiment, from among the oblique columnar support portions 42, each other oblique columnar support portion other than the oblique columnar support portion 43 is also formed in a rod shape in an identical manner to the oblique columnar support portion 43 and is disposed along a straight line inclined with respect to the axial direction 35. Alternatively, only some of the oblique columnar support portions can be disposed along straight lines inclined with respect to the axial direction 35. The oblique columnar support portions 42 are formed in an integrated manner, are fixed to each other, and are fixed to the housing main body 21.

Operations of Air Conditioning Device

The air conditioning device circulates a refrigerant between the indoor equipment 10 and the outdoor equipment. The outdoor equipment performs heat exchange between the refrigerant and the outside air. The air blower 1 uses the motor unit to rotate the tangential fan 8 around the rotation axis 16 and in the rotation direction 40. As a result of the rotation of the tangential fan 8, the air blower 1 supplies the air present in the air conditioned room to the air passageway 24 from the suction opening 25 of the indoor equipment 10. The heat exchanger 3 performs heat exchange between the air, which is supplied to the air passageway 24 from the suction opening 25, and the refrigerant; and adjusts the temperature of the air supplied to the air passageway 24. Then, the air having its temperature adjusted by the heat exchanger 3 is blown into the air conditioned room from the vent 12. As a result of performing such operations, the air conditioning device becomes able to either cool or heat the air conditioned room.

Figure 4:
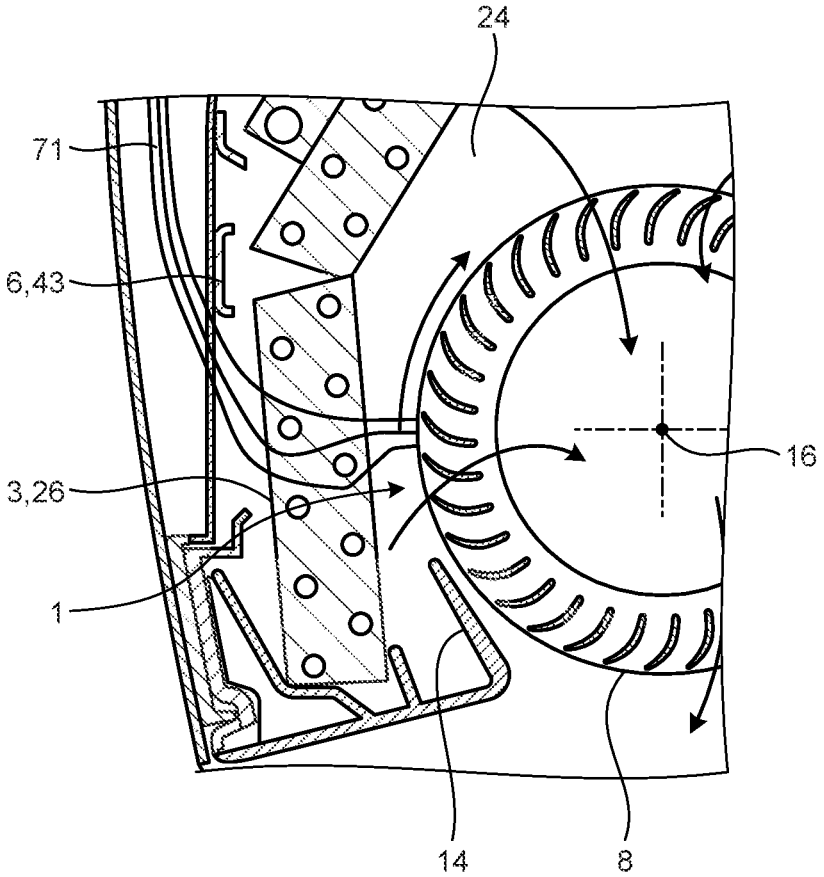
FIG. 4 is a lateral cross-sectional view illustrating a cross-sectional surface on which the plane having one end of an oblique columnar support portion passing therethrough intersects with the indoor equipment of the air conditioning device according to the first embodiment.
Figure 5:
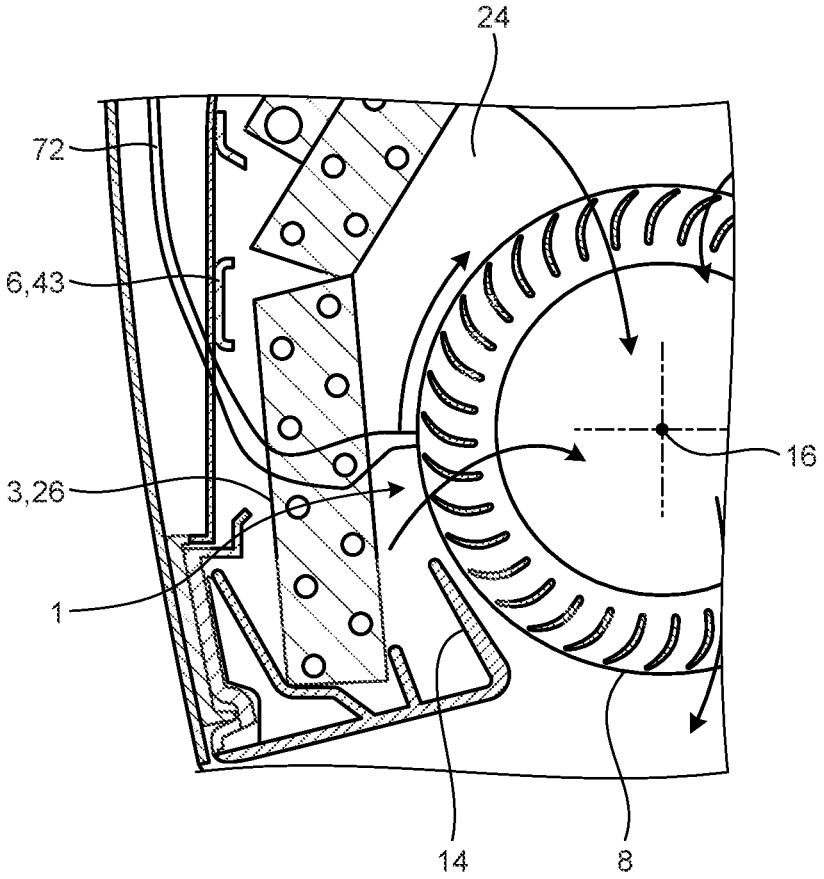
FIG. 5 is another lateral cross-sectional view illustrating a cross-sectional surface on which the plane having the other end of the oblique columnar support portion passing therethrough intersects with the indoor equipment of the air conditioning device according to the first embodiment.

FIG. 4 is a lateral cross-sectional view obtained when the indoor equipment 10 of the air conditioning device according to the first embodiment is cut in the plane through which one end of the oblique columnar support portion 43 (i.e., the left end portion illustrated in FIG. 3) passes and which is orthogonal to the rotation axis 16. Herein, a flowline 71 represents the flow of the air passing by the vicinity of the concerned one end of the oblique columnar support portion 43. The air passing through the air passageway 24 along the flowline 71 passes through the frontside heat exchanger 26 and gets supplied to the air blower 1. FIG. 5 is a lateral cross-sectional view obtained when the indoor equipment 10 of the air conditioning device according to the first embodiment is cut in the plane through which the other end of the oblique columnar support portion 43 (i.e., the right end portion illustrated in FIG. 3) passes and which is orthogonal to the rotation axis 16. Herein, a flowline 72 represents the flow of the air passing by the vicinity of the other end of the oblique columnar support portion 43. The air passing through the air passageway 24 along the flowline 72 passes through the frontside heat exchanger 26 and gets supplied to the air blower 1.

The straight line followed by the oblique columnar support portion 43 is inclined with respect to the axial direction 35. Hence, the position of placement of the other end of the oblique columnar support portion 43 with respect to the heat exchanger 3 is different in the height direction (i.e., the direction parallel to the straight line that follows the cross-sectional surface of the frontside heat exchanger 26 illustrated in FIG. 4) than the position of placement of the concerned one end of the oblique columnar support portion 43 with respect to the heat exchanger 3. Since the position of the other end of the oblique columnar support portion 43 is different than the position of the concerned one end thereof, the flowline 72 followed by the air flowing in the vicinity of the other end of the oblique columnar support portion 43 is different than the flowline 71 followed by the air flowing in the vicinity of the one end of the oblique columnar support portion 43.

In the frontside heat exchanger 26, a wind noise is generated when the air passes therethrough. The wind noise includes a one end wind noise and an other end wind noise. The one end wind noise is generated in the portion through which passes the air that flows along the flowline 71. The other end wind noise is generated in the portion through which passes the air that flows along the flowline 72. The wind noise gets generated at the places at which the distance between the frontside heat exchanger 26 and the tangential fan 8 is the shortest (i.e., the wind noise gets generated in the vicinity of the dead ends of the flowlines 71 and 72 on the side of the tangential fan 8). With reference to those places, the oblique columnar support portion 43 is positioned on the upstream side of the flow of the air. If the position of the oblique columnar support portion 43 is different, then the flow velocity of the air at those places also differs. As compared to the position of the oblique columnar support portion 43 at the concerned one end, the position of the oblique columnar support portion 43 at the other end has a position overlap on the upstream side of the flow of the air. That is, the flow velocity of the air that flows along the flowline 71 and passes through the frontside heat exchanger 26 is greater than the flow velocity of the air that flows along the flowline 72 and passes through the frontside heat exchanger 26. The frequency of the wind noise varies according to the flow velocity. Conventionally, the wind noise having a constant frequency is generated from one end to the other end of the frontside heat exchanger 26 in the axial direction 35. Hence, when the frequency of the wind noise overlaps with the frequency of the blade pitch sound, the resonance results in a high level of noise. In contrast, in the application concerned, the frequency of the wind noise is dispersed across the ends of the heat exchanger 3 in the axial direction 35. That enables achieving reduction in the portion in which the sound resonating with the blade pitch sound is generated. As a result, the noise attributed to the resonance gets reduced.

Figure 6:
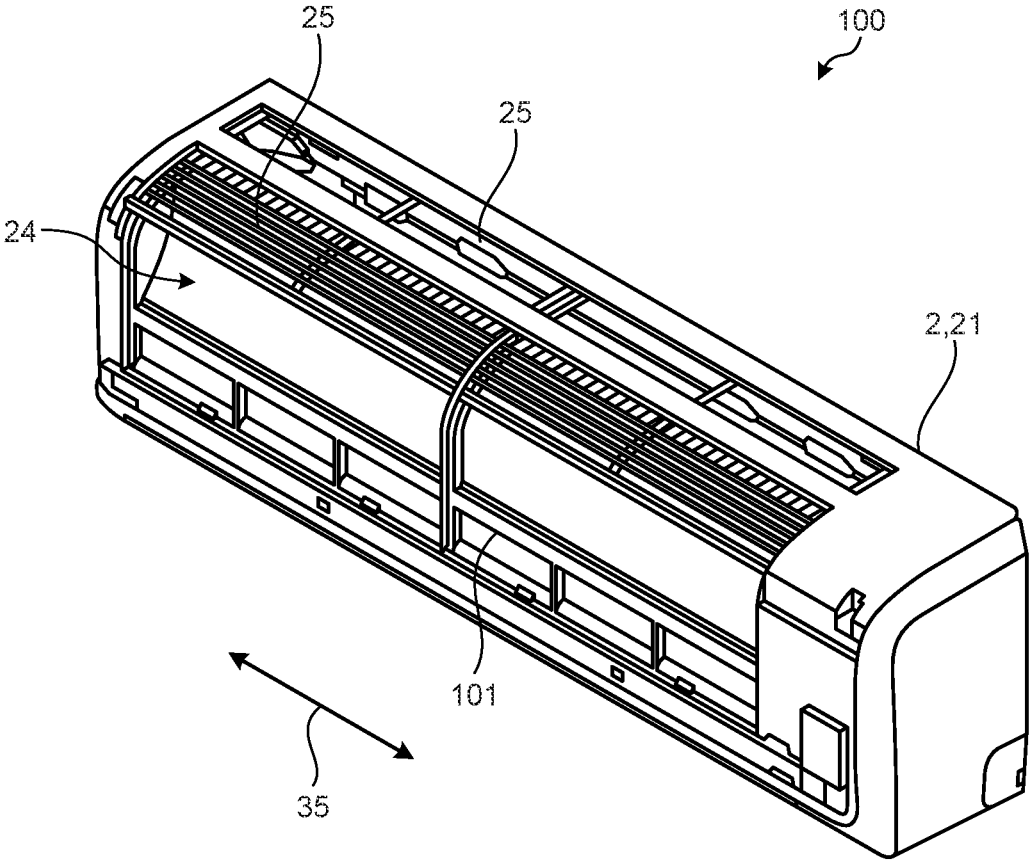
FIG. 6 is a perspective view of an indoor equipment of an air conditioning device according to a first comparison example.

FIG. 6 is a perspective view of an indoor equipment 100 of an air conditioning device according to a first comparison example. In the indoor equipment 100 of the air conditioning device according to the first comparison example, the columnar support 6 in the indoor equipment 10 of the air conditioning device according to the first embodiment is replaced with a columnar support 101, and the other constituent elements are same as the constituent elements of the indoor equipment 10 of the air conditioning device according to the first embodiment described above. The columnar support 101 is formed in a rod shape, is placed along a straight line parallel to the axial direction 35, and is fixed to the housing main body 21. In the air passageway 24, regarding the air that passes by the vicinity of the columnar support 101, there is roughly equal airflow passing through a plurality of different regions in the axial direction 35 due to the fact that the columnar support 101 follows a straight line that is parallel to the axial direction 35.

At that time, a plurality of wind noises generated in a plurality of different portions in the axial direction 35 has the same frequency. When the wind noises having the same frequency get overlapped, it leads to an increase in the level of noise. In that regard, as compared to the indoor equipment 100 of the air conditioning device according to the first comparison example, the indoor equipment 10 of the air conditioning device according to the first embodiment enables holding down an increase in the level of noise attributed to the wind noise.

Effects of Air Conditioning Device According to First Embodiment

The indoor equipment 10 of the air conditioning device according to the first embodiment includes: the tangential fan 8; the columnar support 6; the heat exchanger 3 disposed between the columnar support 6 and the tangential fan 8; and the motor unit that rotates the tangential fan 8 around the rotation axis 16 and lets the air pass through the heat exchanger 3. Of the columnar support 6, some part (the oblique columnar support portion 43) is disposed along a straight line that is inclined with respect to the rotation axis 16. The indoor equipment 10 of the air conditioning device according to the first embodiment enables holding down an increase in the level of noise attributed to the overlapping of a plurality of wind noises generated at a plurality of different positions in the axial direction 35.

In the indoor equipment 10 of the air conditioning device according to the first embodiment, the columnar support 6 is made of a plurality of oblique columnar support portions 42 disposed along a plurality of straight lines inclined with respect to the axial direction 35. Thus, the indoor equipment 10 of the air conditioning device according to the first embodiment enables holding down an increase in the level of noise, which is attributed to the wind noise, across the full width of the air blower 1 in the axial direction 35.

The indoor equipment 10 of the air conditioning device according to the first embodiment further includes the filter 5 that removes dust from the air. The columnar support 6 is disposed in between the filter 5 and the heat exchanger 3. That is, the columnar support 6 is used for preventing the filter 5 from making contact with the heat exchanger 3. In the indoor equipment 10 of the air conditioning device according to the first embodiment, since the filter 5 is prevented from making contact with the heat exchanger 3, it also becomes possible to prevent deformation of the fins provided in the heat exchanger 3.

Second Embodiment

Figure 7:
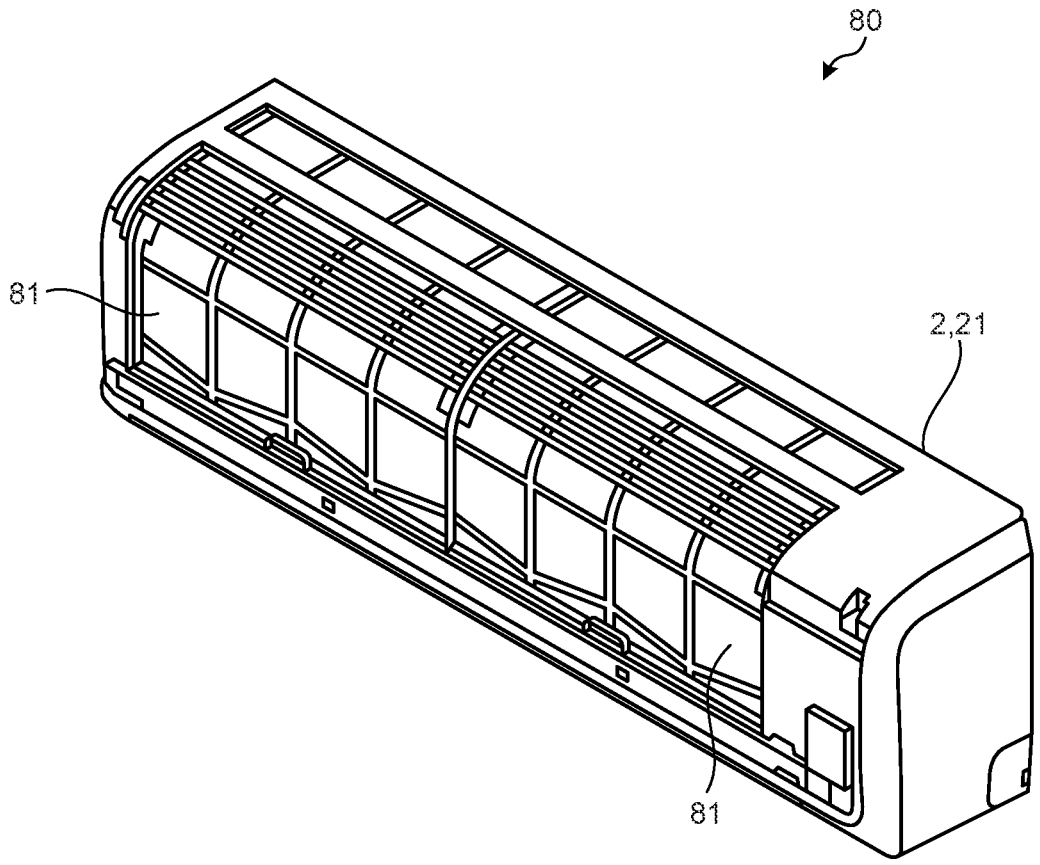
FIG. 7 is a perspective view of an indoor equipment, from which the front panel has been removed, of an air conditioning device according to a second embodiment.
Figure 8:
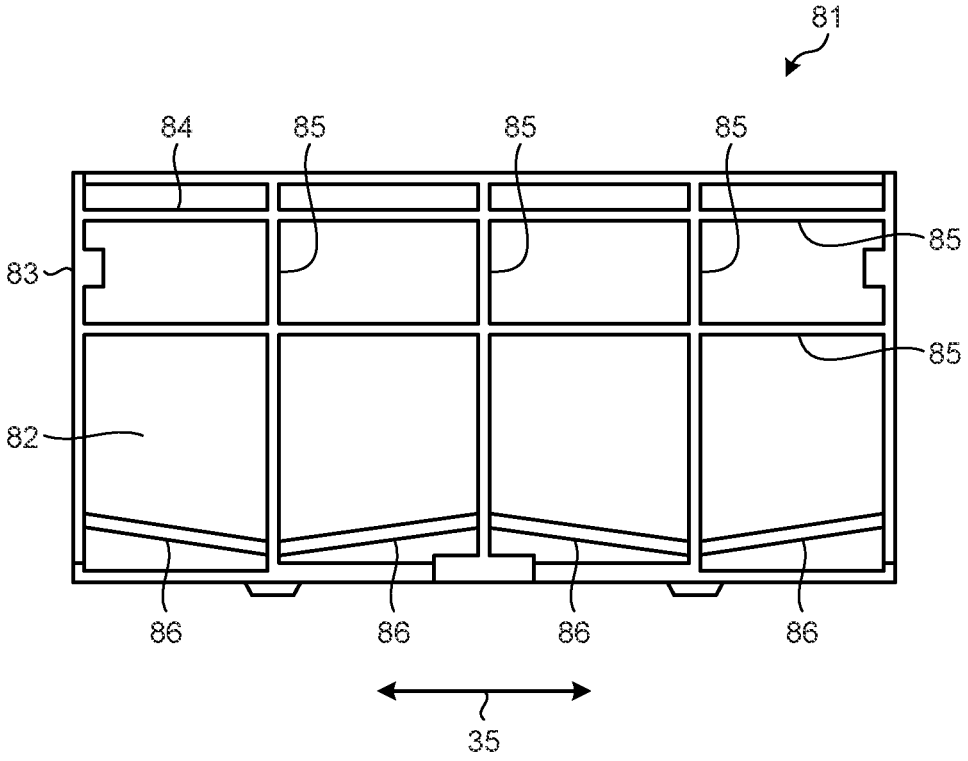
FIG. 8 is a planar view of a filter of the indoor equipment of the air conditioning device according to the second embodiment.

In an indoor equipment 80 of the air conditioning device according to a second embodiment, as illustrated in FIG. 7, the filter 5 in the indoor equipment 10 of the air conditioning device according to the first embodiment is replaced with a filter 81, and the other constituent elements are same as the constituent elements of the indoor equipment 10 of the air conditioning device according to the first embodiment described above. FIG. 7 is a perspective view of the indoor equipment 80, from which the front panel 22 has been removed, of the air conditioning device according to the second embodiment. FIG. 8 is a planar view of the filter 81 of the indoor equipment 80 of the air conditioning device according to the second embodiment. The filter 81 includes a filter main body 82, a frame 83, and a plurality of sash bars 84. The filter main body 82 is formed in the shape of a rectangular sheet. Moreover, the filter main body 82 is formed to be reticular so that the air can pass in the thickness direction of the filter 81 and that dust is removed from the air passing through the filter 81.

As illustrated in FIG. 8, the frame 83 is formed in a rod shape around the filter main body 82, and is fixed to the rim of the filter main body 82. The frame 83 prevents deformation of the filter 81 from a predetermined shape. The sash bars 84 are formed in a rod shape. Moreover, the sash bars 84 are disposed along the filter main body 82 and are fixed to the filter main body 82. Furthermore, the sash bars 84 are fixed to each other in an integrated manner and are also fixed to the frame 83. The sash bars 84 prevent deformation of the filter 81 from a predetermined shape.

The sash bars 84 include columnar support portions mentioned in claims. The columnar support portions included in the sash bars 84 include a plurality of columnar support portions 85 and a plurality of oblique columnar support portions 86. The straight lines followed by the columnar support portions 85 are either parallel to the axial direction 35 or orthogonal to the axial direction 35. The straight lines followed by the oblique columnar support portions 86 are inclined with respect to the axial direction 35, that is, are neither parallel to the axial direction 35 nor orthogonal to the axial direction 35.

In an identical manner to the oblique columnar support portions 42 of the columnar support 6 in the indoor equipment 10 of the air conditioning device according to the first embodiment described above, the oblique columnar support portions 86 have different positions in the height direction (i.e., the direction parallel to the straight line that follows the cross-sectional surface of the frontside heat exchanger 26 illustrated in FIG. 4) than the position of placement of the concerned one end of oblique columnar support portion 43 with respect to the heat exchanger 3. In an identical manner to the air conditioning device according to the first embodiment, since the flow velocity of the air is ensured to be different according to the position of the oblique columnar support portion 43, a plurality of wind noises generated at a plurality of parts can be ensured to be different from each other. Hence, in an identical manner to the indoor equipment 10 of the air conditioning device according to the first embodiment described above, in the indoor equipment 80 of the air conditioning device according to the second embodiment, it becomes possible to hold down an increase in the level of noise attributed to the overlapping of a plurality of wind noises generated at a plurality of different positions in the axial direction 35.

Air Conditioning Device According to Second Comparison Example

Figure 9:
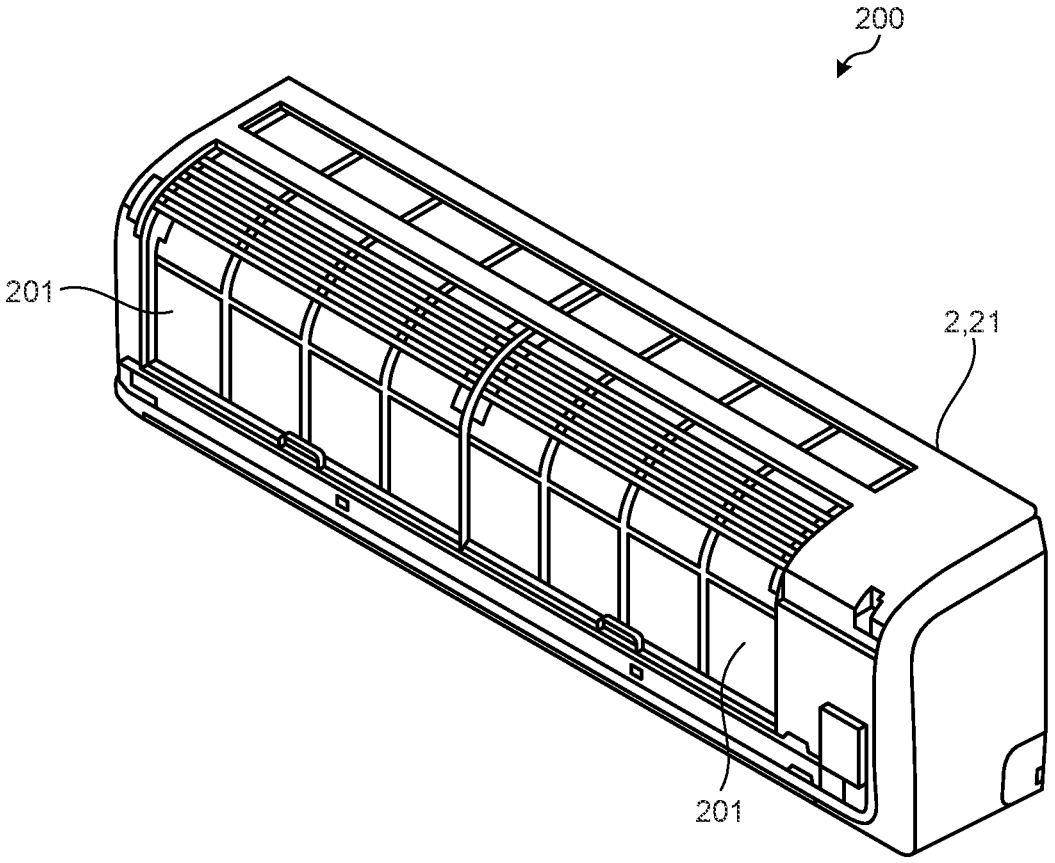
FIG. 9 is a perspective view of the indoor equipment, from which the front panel has been removed, of the air conditioning device according to the second comparison example.
Figure 10:
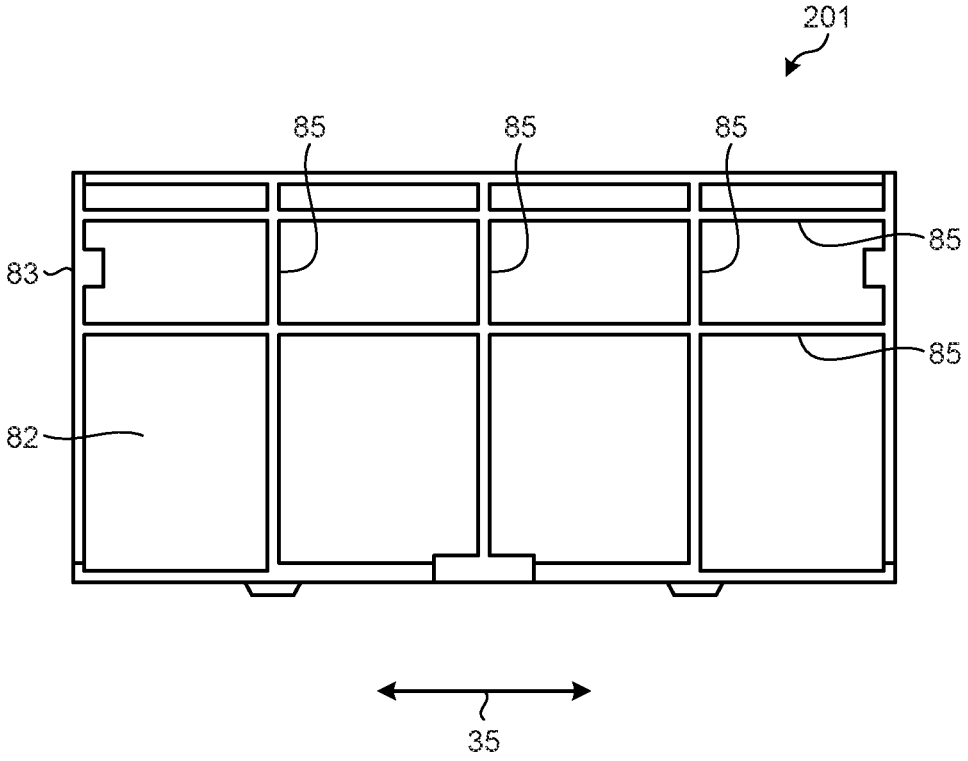
FIG. 10 is a planar view of a filter of the indoor equipment of the air conditioning device according to the second comparison example.

In an indoor equipment 200 of an air conditioning device according to a second comparison example, as illustrated in FIG. 9, the filter 81 in the indoor equipment 80 of the air conditioning device according to the second embodiment described above is replaced with a filter 201, and the other constituent elements are same as the constituent elements of the indoor equipment 80 of the air conditioning device according to the second embodiment described above. FIG. 9 is a perspective view of the indoor equipment 200, from which the front panel 22 has been removed, of the air conditioning device according to the second comparison example. FIG. 10 is a planar view of the filter 201 of the indoor equipment 200 of the air conditioning device according to the second comparison example. The filter 201 is configured by omitting the oblique columnar support portions 86 from the filter 81, and the other constituent elements are same as the constituent elements of the filter 81. That is, the filter 201 includes the filter main body 82, the frame 83, and the columnar support portions 85.

Regarding the air that flows through the filter 201, there is roughly equal airflow passing through a plurality of different regions in the axial direction due to the fact that all of the columnar support portions 85 are either parallel to the axial direction 35 or orthogonal to the axial direction 35. Thus, a plurality of wind noises generated in a plurality of different portions in the axial direction 35 sometimes has the same frequency. When the wind noises having the same frequency get overlapped, it leads to an increase in the level of noise. In that regard, as compared to the indoor equipment 200 of the air conditioning device according to the second comparison example, the indoor equipment 80 of the air conditioning device according to the second embodiment enables holding down an increase in the level of noise attributed to the wind noise.

Meanwhile, the indoor equipment 80 of the air conditioning device according to the second embodiment described above has the oblique columnar support portions 42 disposed therein. However, alternatively, the oblique columnar support portions 42 can be replaced with the columnar support 101 of the indoor equipment 100 of the air conditioning device according to the first comparison example. In the indoor equipment 80 of the air conditioning device according to the second embodiment described above, even when the oblique columnar support portions 42 are replaced with the columnar support 101, the presence of the oblique columnar support portions 86 enables holding down an increase in the level of noise attributed to the wind noise.

Third Embodiment

Figure 11:
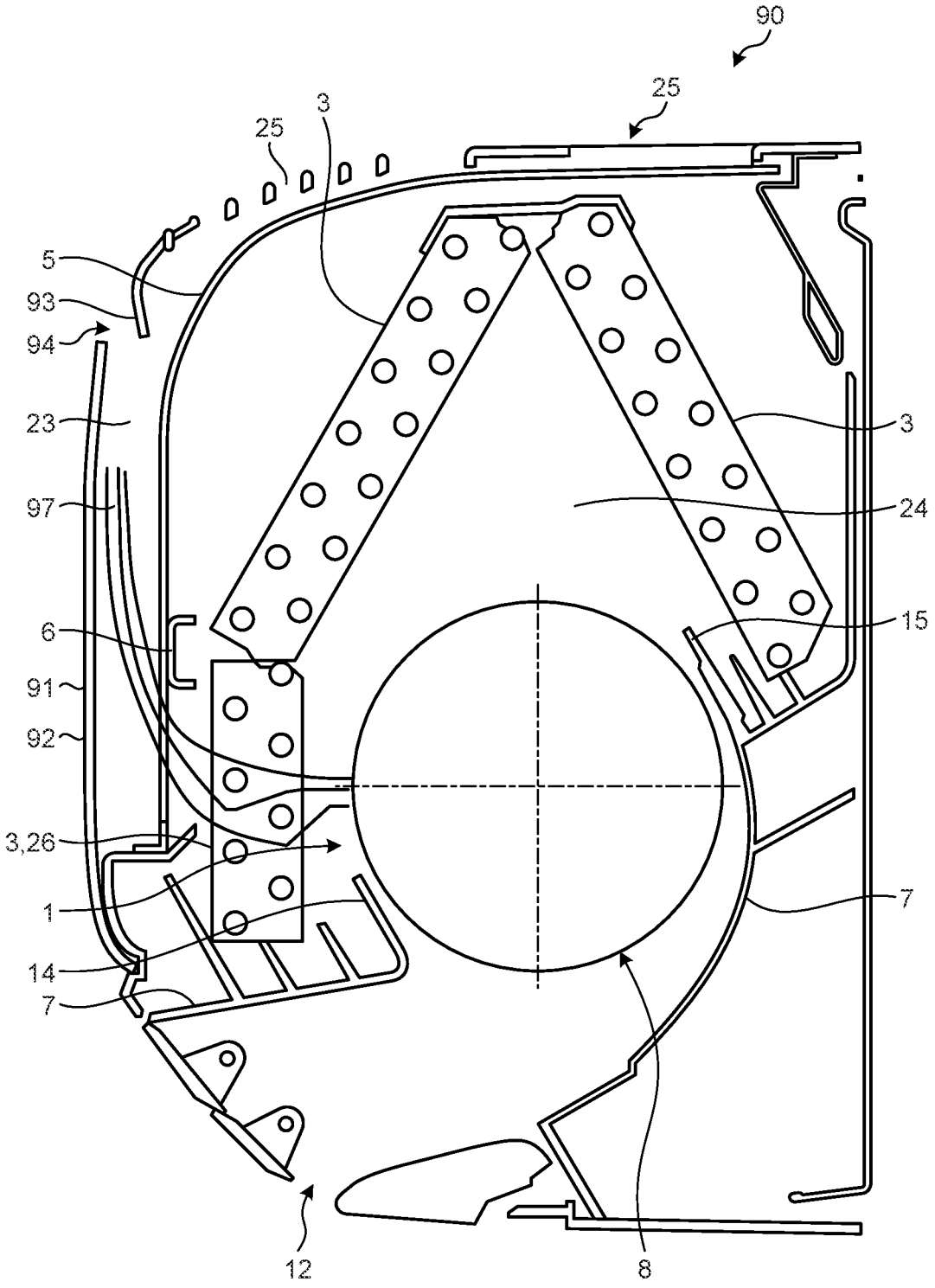
FIG. 11 is a lateral cross-sectional view of an indoor equipment of an air conditioning device according to a third embodiment.

In an indoor equipment 90 of an air conditioning device according to a third embodiment, as illustrated in FIG. 11, the front panel 22 of the indoor equipment 10 of the air conditioning device according to the first embodiment described earlier is replaced with a front panel 91, and the other constituent elements are same as the constituent elements of the indoor equipment 10 of the air conditioning device according to the first embodiment described earlier. FIG. 11 is a lateral cross-sectional view of the indoor equipment 90 of the air conditioning device according to the third embodiment. The front panel 91 includes a front panel main body 92 and a plurality of reinforcing members 93. In an identical manner to the front panel 22 of the indoor equipment 10 of the air conditioning device according to the first embodiment described earlier, the front panel main body 92 is disposed on the front side of the housing main body 21 in such a way that the frontside opening 23 gets covered by the front panel 91. The front panel main body 92 is attached in a detachably attachable manner to the housing main body 21, and is fixed to the housing main body 21. In the front panel main body 92, a plurality of frontside suction openings 94 is formed.

Figure 12:
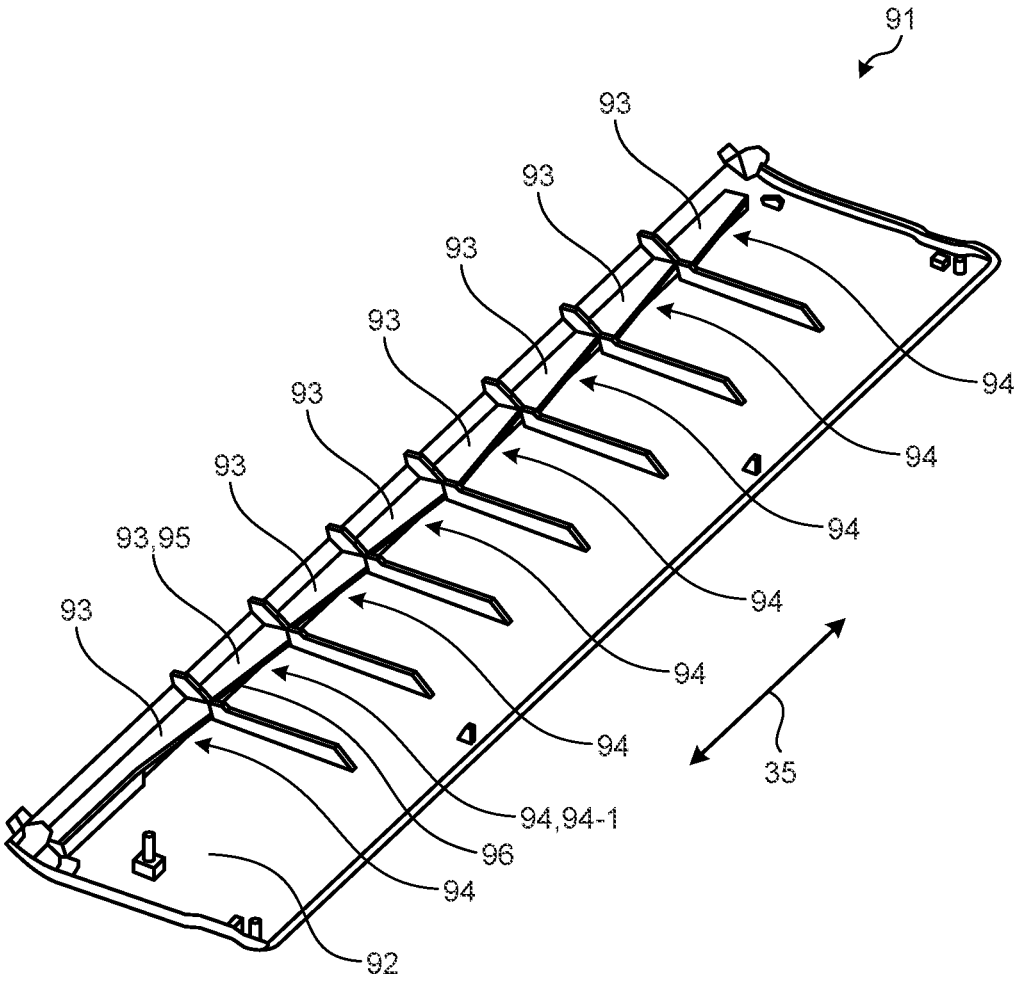
FIG. 12 is a perspective view of a front panel of the indoor equipment of the air conditioning device according to the third embodiment.

FIG. 12 is a perspective view of the front panel 91 of the indoor equipment 90 of the air conditioning device according to the third embodiment. The frontside suction openings 94 are formed at the upper end of the front panel main body 92 and in the axial direction 35. The reinforcing members 93 are disposed in a corresponding manner to the frontside suction openings 94. From among the reinforcing members 93, one reinforcing member 95 corresponding to a frontside suction opening 94-1 is formed in the vicinity of the frontside suction opening 94-1, is formed parallel to the axial direction 35, and is formed substantially orthogonal to the plane of the front panel 91. The upper end of the reinforcing member 95 is placed at the upper end of the frontside suction opening 94-1 and is fixed to the front panel main body 92. The reinforcing member 95 is so formed that a lower end 96 thereof follows a straight line. The straight line followed by the lower end 96 of the reinforcing member 95 is inclined with respect to the axial direction 35, that is, is neither parallel to the axial direction 35 nor orthogonal to the axial direction 35. From among the reinforcing members 93, the other reinforcing members other than the reinforcing member 95 are also formed in an identical manner to the reinforcing member 95. In the indoor equipment 90 of the air conditioning device according to the third embodiment, as a result of having a plurality of reinforcing members 93 in the front panel 91, it becomes possible to reinforce the front panel 91 in such a way that the front panel main body 92 does not get deformed even when the frontside suction openings 94 are formed on the front panel 91.

Figure 13:
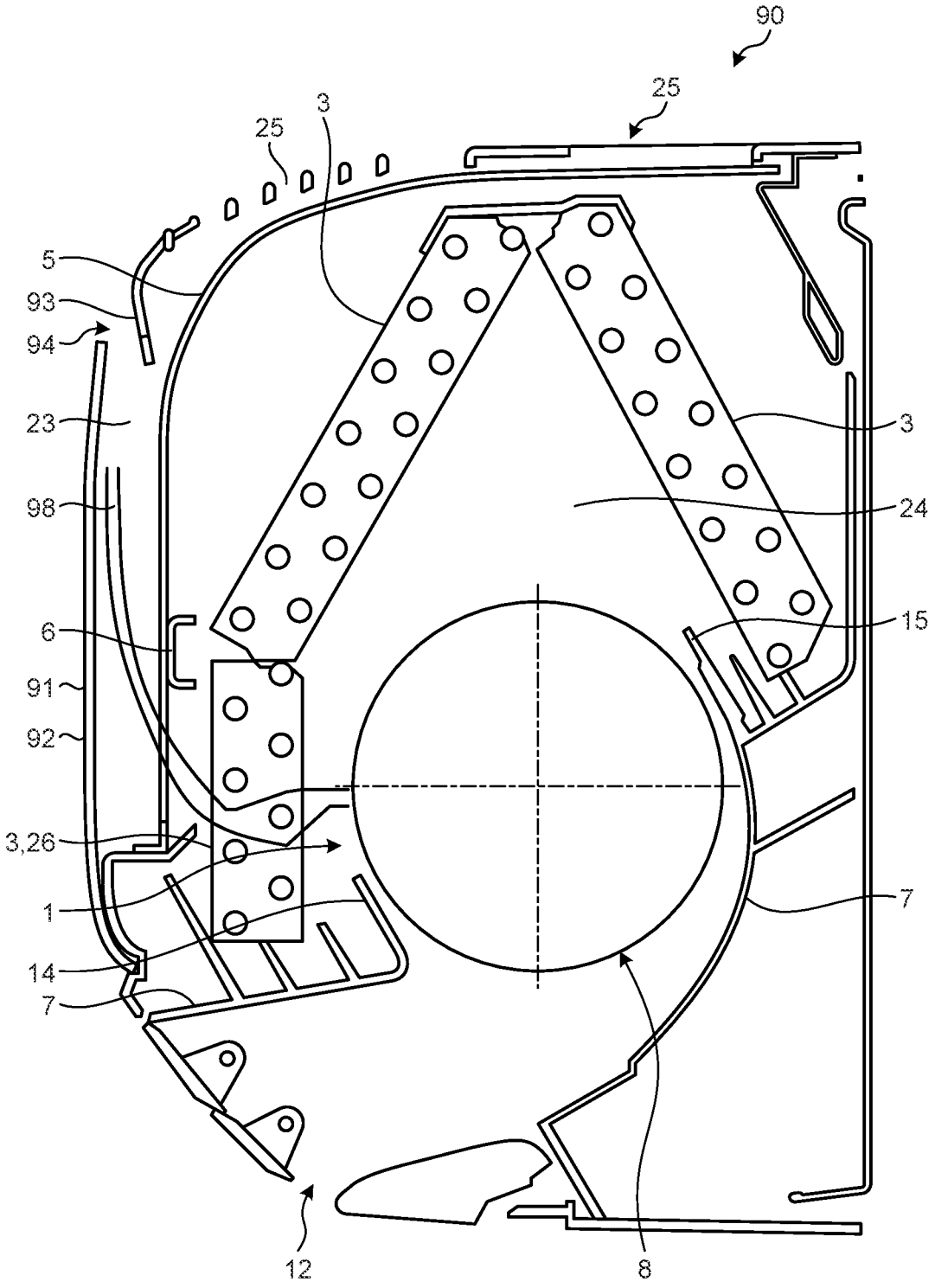
FIG. 13 is a lateral cross-sectional view illustrating a cross-sectional surface on which the plane having one end of the oblique columnar support portion passing therethrough intersects with the indoor equipment of the air conditioning device according to the third embodiment.

In the indoor equipment 90 of the air conditioning device according to the third embodiment, when the tangential fan 8 rotates, the air in the air conditioned room is supplied to the air passageway 24 from the suction opening 25 as well as from the frontside suction openings 94. The air that passes by the vicinity of one end of the reinforcing member 95 in the axial direction passes through the air passageway 24 along a flowline 98, then passes through the frontside heat exchanger 26, and is then supplied to the air blower 1 as illustrated in FIG. 13. FIG. 13 is a lateral cross-sectional view illustrating a cross-sectional surface on which the plane having one end of the oblique columnar support portion 43 passing therethrough intersects with the indoor equipment 90 of the air conditioning device according to the third embodiment. The air that has passes by the vicinity of the other end of the reinforcing member 95 in the axial direction 35 passes through the air passageway 24 along a flowline 97, then passes through the frontside heat exchanger 26, and is then supplied to the air blower 1.

Since the straight line followed by the lower end of the reinforcing member 95 is inclined with respect to the axial direction 35, the position of placement of the other end of the lower end 96 is different than the position of placement of the concerned one end of the lower end 96. Since the position of the other end of the lower end 96 is different in the height direction (i.e., the direction parallel to the straight line that follows the cross-sectional surface of the frontside heat exchanger 26 illustrated in FIG. 13) than the position of the concerned one end of the lower end 96, the flowline 97 followed by the air flowing in the vicinity of the other end of the reinforcing member 95 is different than the flowline 98 followed by the air flowing in the vicinity of the concerned one end of the reinforcing member 95.

In an identical manner to the oblique columnar support portions 42 of the columnar support 6 of the indoor equipment 10 in the air conditioning device according to the first embodiment described earlier, the reinforcing members 93 can ensure that different wind noises are generated in a plurality of parts having mutually different positions in the frontside tongue portion 14 in the axial direction 35. Hence, in an identical manner to the indoor equipment 10 of the air conditioning device according to the first embodiment described earlier, in the indoor equipment 90 of the air conditioning device according to the third embodiment, it becomes possible to hold down an increase in the level of noise attributed to the overlapping of a plurality of wind noises generated at a plurality of different positions in the axial direction 35.

Air Conditioning Device According to Third Comparison Example

Figure 14:
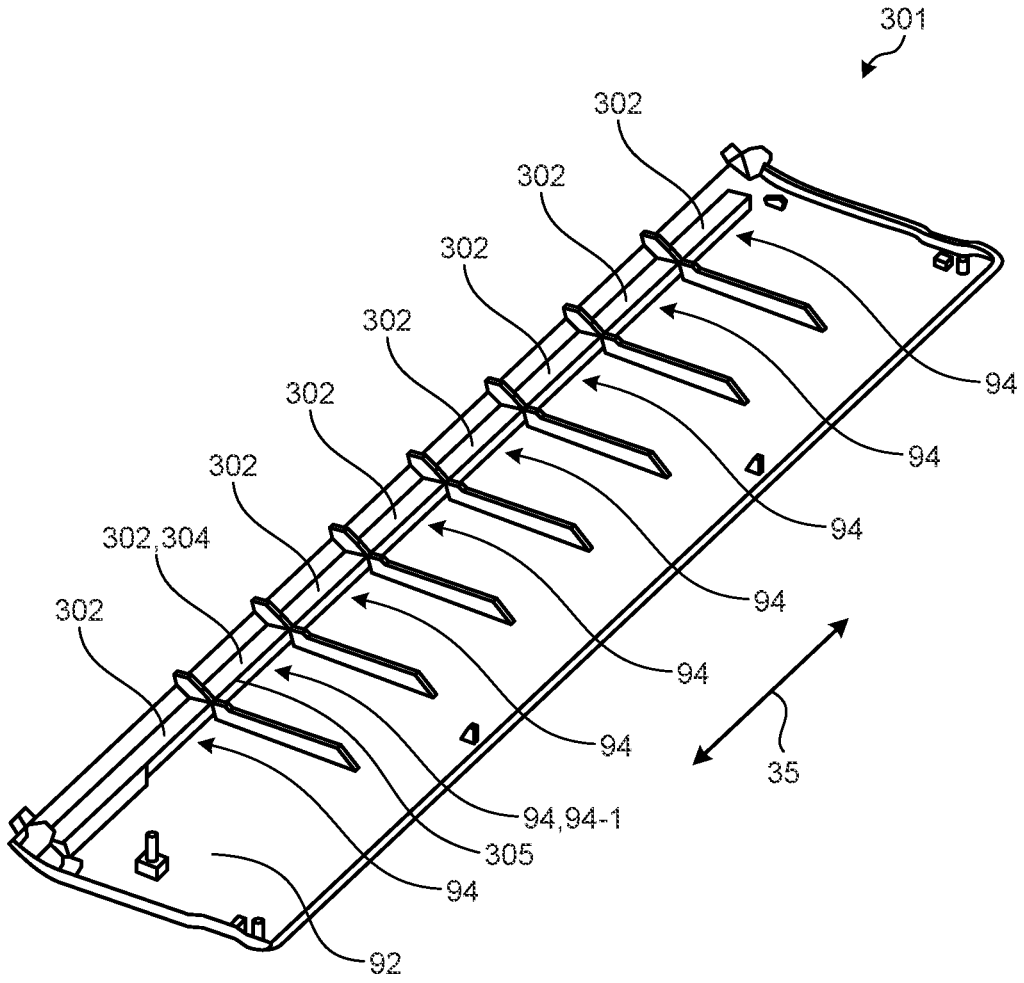
FIG. 14 is a perspective view of a front panel of an indoor equipment of an air conditioning device according to a third comparison example.

In an indoor equipment of an air conditioning device according to a third comparison example, as illustrated in FIG. 14, the front panel 91 of the indoor equipment 90 of the air conditioning device according to the third embodiment described above is replaced with a front panel 301, and the other constituent elements are same as the constituent elements of the indoor equipment 90 according to the third embodiment described above. FIG. 14 is a perspective view of the front panel 301 of the indoor equipment of the air conditioning device according to the third comparison example. In the front panel 301, the reinforcing members 93 of the front panel 91 explained earlier are replaced with a plurality of reinforcing members 302, and the other constituent elements are same as the constituent elements of the front panel 91. From among the reinforcing members 302, one reinforcing member 304 corresponding to the frontside suction opening 94-1 is placed close to the frontside suction opening 94-1 and along a vertical plane parallel to the axial direction 35. The upper end of the reinforcing member 304 is placed at the upper end of the frontside suction opening 94-1 and is fixed to the front panel main body 92. The reinforcing member 304 is formed in such a way that a lower end 305 thereof follows a straight line. The straight line followed by the lower end 305 of the reinforcing member 304 is parallel to the axial direction 35. From among the reinforcing members 302, the other reinforcing members other than the reinforcing member 304 are also formed in an identical manner to the reinforcing member 304.

Since the lower end 305 of the reinforcing member 304 is parallel to the axial direction 35, there is roughly equal airflow passing by the vicinity of a plurality of different parts of the reinforcing member 304 in the axial direction 35. At that time, a plurality of wind noises generated in a plurality of different portions of the heat exchanger 3 in the axial direction 35 has the same frequency. When the frequencies of a plurality of wind noises get overlapped, it leads to an increase in the level of noise. In that regard, as compared to the indoor equipment of the air conditioning device according to the third comparison example, the indoor equipment 90 of the air conditioning device according to the third embodiment enables holding down an increase in the level of noise attributed to the wind noise.

Meanwhile, the indoor equipment 90 of the air conditioning device according to the third embodiment described above has the oblique columnar support portions 42 disposed therein. However, alternatively, the oblique columnar support portions 42 can be replaced with the columnar support 101 of the indoor equipment 100 of the air conditioning device according to the first comparison example. In the indoor equipment 90 of the air conditioning device according to the third embodiment described above, even when the oblique columnar support portions 42 are replaced with the columnar support 101, the presence of the reinforcing members 93 enables holding down an increase in the level of noise attributed to the wind noise.

In the indoor equipment 90 of the air conditioning device according to the third embodiment described above, the front panel main body 92 has the frontside suction openings 94 formed thereon. However, alternatively, the frontside suction openings 94 can be absent. In the indoor equipment 90 of the air conditioning device according to the third embodiment described above, even when the frontside suction openings 94 are not formed on the front panel main body 92, it can be ensured to have different airflow through a plurality of different positions of the air passageway 24 in the axial direction 35.

In the indoor equipment 10, 80, 90 of the air conditioning device according to the embodiments, the tangential fan 8 is disposed that sucks in the air from a radial direction and blows out the air from another radial direction. However, alternatively, a multiblade fan can be disposed that is different than a tangential fan. Examples of a multiblade fan include a fan that sucks in the air from a radial direction and blows out the air from the axial direction 35. In such an indoor equipment too, in an identical manner to the indoor equipment of the air conditioning device according to the embodiments, it becomes possible to hold down an increase in the level of noise attributed to the wind noise.

Although the application concerned has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

REFERENCE SIGNS LIST

10 indoor equipment
3 heat exchanger
5 filter
6 columnar support
8 tangential fan
14 frontside tongue portion
15 backside tongue portion
16 rotation axis
22 front panel
24 air passageway
25 suction opening
31 plurality of impellers
35 radial direction
42 plurality of oblique columnar support portions
80 indoor equipment
81 filter
86 plurality of oblique columnar support portions
90 indoor equipment
91 front panel

92 front panel main body
93 plurality of reinforcing members
94 plurality of frontside suction openings
95 reinforcing member

The invention claimed is:

1. An air conditioning device comprising:

a tangential fan;

a front panel;

a reinforcing member that is disposed at an end of a suction opening formed on the front panel, and is fixed to and integrally formed with the front panel;

a heat exchanger that is disposed between the front panel and the tangential fan; and a motor configured to rotate the tangential fan around a rotation axis and cause air to pass through the heat exchanger from the suction opening, wherein at least a part of a distal end of the reinforcing member opposite to an end connected to the front panel is placed along a straight line that is inclined with respect to the rotation axis, such that distance between the front panel and one end of the part of the distal end of the reinforcing member in an axial direction parallel to the rotation axis is different from distance between the front panel and another end of the part of the distal end of the reinforcing member opposite to the one end in the axial direction.

2. The air conditioning device according to claim 1, wherein the distal end is made of a plurality of portions that are placed along a plurality of straight lines, respectively, inclined with respect to the axial direction.

* * * * *